US009574837B2

(12) United States Patent
Sullivan et al.

(10) Patent No.: US 9,574,837 B2
(45) Date of Patent: Feb. 21, 2017

(54) MORTAR SAFETY DEVICE

(71) Applicant: NOSTROMO, LLC, Alexandria, VA (US)

(72) Inventors: Kevin Michael Sullivan, Kennebunk, ME (US); Marcelo Eduardo Edgardo Martinez, Cordoba (AR); Nicolas Horacio Bruno, Cordoba (AR); Nicholas Somich, Stafford, VA (US)

(73) Assignee: NOSTROMO HOLDINGS, LLC, Alexandria, VA (US)

( * ) Notice: Subject to any disclaimer, the term of this patent is extended or adjusted under 35 U.S.C. 154(b) by 0 days.

(21) Appl. No.: 14/592,209

(22) Filed: Jan. 8, 2015

(65) Prior Publication Data

US 2015/0330732 A1 Nov. 19, 2015

Related U.S. Application Data

(60) Provisional application No. 61/924,749, filed on Jan. 8, 2014.

(51) Int. Cl.

| | |
|---|---|
| ***F41A 17/06*** | (2006.01) |
| ***F41A 17/14*** | (2006.01) |
| ***F41A 17/18*** | (2006.01) |
| *F41F 1/06* | (2006.01) |

(52) U.S. Cl.

CPC ..... *F41A 17/14* (2013.01); *F41A 17/06* (2013.01); *F41A 17/18* (2013.01); *F41F 1/06* (2013.01)

(58) Field of Classification Search

CPC ..... F42C 17/00; F42C 17/04
USPC ..... 89/1.3, 6, 6.5
See application file for complete search history.

(56) References Cited

U.S. PATENT DOCUMENTS

| | | | | |
|---|---|---|---|---|
| 3,698,282 | A | 10/1972 | Albatys | |
| 5,834,675 | A * | 11/1998 | Boss | F42C 17/04 235/408 |
| 5,965,835 | A | 10/1999 | Gartz | |
| 7,021,187 | B1 * | 4/2006 | Grassi | F42B 30/04 89/6.5 |
| 7,595,633 | B2 * | 9/2009 | Martin | G01P 3/665 324/179 |
| 8,800,359 | B2 * | 8/2014 | Furch | F41A 21/325 73/167 |
| 2006/0156804 | A1 * | 7/2006 | Shipman | F41A 21/32 73/167 |

(Continued)

FOREIGN PATENT DOCUMENTS

| | | |
|---|---|---|
| DE | 318163 | 1/1920 |
| WO | 2013144808 A1 | 10/2013 |

OTHER PUBLICATIONS

European Search Report Dated Jun. 1, 2015 From Corresponding EP Application No. 15000025.5.

*Primary Examiner* — Stephen M Johnson
(74) *Attorney, Agent, or Firm* — Karl F. Milde, Jr.; Eckert Seamans Cherin & Mellott, LLC

(57) ABSTRACT

A safety device for a front-loading weapon of the type comprising a mortar barrel having a closed breech end and an opposite open end for launching a mortar projectile. The device includes at least one sensor, configured for mounting adjacent the mortar barrel, for sensing a mortar projectile upon its insertion in the barrel and an electronic circuit, coupled to said sensor, for detecting movement of the mortar projectile past said sensor, thereby to detect the presence of the projectile in the barrel.

23 Claims, 21 Drawing Sheets

(56) References Cited

U.S. PATENT DOCUMENTS

2009/0287455 A1 11/2009 Clark et al.

* cited by examiner

MORTAR SAFETY DEVICE

CROSS-REFERENCE TO RELATED APPLICATION

This application claims priority from the U.S. Provisional Application No. 61/924,749 filed Jan. 8, 2014.

BACKGROUND OF THE INVENTION

The present invention concerns a safety device for a front-loading weapon, commonly called a "mortar," which launches projectiles in a high trajectory. The mortar comprises a relatively short barrel having a closed breech end, attached to a breech block forming a base, and an opposite open end, aimed upward, for ejecting the projectile. The mortar is loaded by inserting self-propelled projectiles into the open end of the barrel. Each round is inserted, front end forward, and falls backward inside the barrel. At the breech end of the barrel the projectile is automatically ignited by a firing pin and propelled forward by the propulsive gases emitted from its tail end.

While such an weapon is relatively simple and easy to use, it has been the source of frequent and serious accidents resulting in the loss of life and limb to the attending soldiers, called "mortar men." Such accidents arise from a dangerous combination of circumstances, such as misfires, hang-fires (failure to fire right away) and double loading of the mortar rounds, that lead to inadvertent detonation of this ammunition.

Modern mortars are capable of high rates of fire (up to 30 rounds for the first one or two minutes of fire). Mortar men are trained to detect hang fires, but in the frenzy of firing, hang fires and misfires can go undetected with catastrophic results.

The chart below is a short list of known accidents associated with a mortar crew inadvertently double loading a mortar. This situation can easily occur when (1) the mortar has a "low order" event, (2) the mortar crew is rushed and does not observe proper firing, and/or (3) the mortar suffers a hang-fire and the crew is unaware that a mortar round did not fire and exit the barrel before a new round was inserted.

| Unit/ | | Mortar | Casualties | | Probable |
|---|---|---|---|---|---|
| Location | Year | Type | Killed | Wounded | Cause |
| US Marines (Nevada) | 2013 | 60 mm | 7 | 8 | Double loading and Hang Fire |
| Romanian Army | 2010 | Unspecified | 3 | 3 | Double loading |
| British Army | 1982 | 81 mm | 3 | 2 | Double loading |
| US Army (Hawaii) | 2006 | 81 mm | 1 | 4 | Double loading |
| Ukrainian Army | 2008 | 120 mm | 1 | 3 | Double loading |
| Finnish Army | 2005 | 120 mm | 1 | 5 | Double loading |
| | Total | | 16 | 40 | 56 Casualties |

Some attempts have been made to address this situation by providing ways to prevent double loading in mortars. One important reference is the U.S. Pat. No. 5,965,835 to Karl Gartz entitled "Apparatus for Monitoring the Loaded or Unloaded Condition of a Front Loading Weapon." This patent discloses a mortar safety device that employs an array of acoustic sensors located inside the barrel and in the breech block. The sensors are piezoelectric devices tuned to measure characteristic vibrations of the round impacting the firing pin, in particular the reaction of the base plate as well as oscillations of the barrel. A filter is used to collect only those signals from such sensors that are compatible with the impact of the round on the firing pin. After processing these signals, information provided by the electronic controller is used to turn on an alert lamp and/or a mechanical device in the muzzle that prevents further loading.

The fact that the sensors are located inside the barrel is a serious drawback of this system because it is not easy retrofit this equipment to existing mortars. The patent fails to teach how the sensors are to be installed, nor does it describe in detail how the tuning is realized.

The U.S. Pat. No. 3,698,282 of Zigmund Albatys, issued Oct. 17, 1972, and entitled "Mortar Safety Device for Preventing Double Loading" describes a purely mechanical device that prevents loading of a mortar round if the barrel has not been cleared by firing a previously loaded projectile. A mechanism located in the muzzle uses a series of arms and locking devices to block the loading of a fresh round until the prior round is fired. This mechanical device returns to its initial position once the barrel is cleared so that a new round can be loaded into the weapon.

SUMMARY OF THE INVENTION

A principal objective of the present invention, therefore, is to provide a warning device for mortar men to prevent an accidental and dangerous combination of circumstances that can lead to inadvertent detonation of ammunition and the loss of life and limb.

This objective, as well as other objectives which will become apparent from the discussion that follows, are achieved, in accordance with the present invention, by providing a safety device for a front-loading weapon that comprises:

(a) at least one sensor, configured for mounting adjacent the mortar barrel, for sensing a mortar projectile in the barrel; and (b) an electronic circuit, coupled to the sensor, for detecting the mortar projectile as it moves past the sensor, thereby to detect the presence of the projectile in the barrel.

Advantageously, the safety device also comprises a warning device coupled to the electronic circuit, for indicating by a sound and/or a light the presence of the mortar projectile in the barrel.

Advantageously also, the electronic circuit is operative to detect a movement of the projectile past the sensor both when entering the barrel and when exiting the barrel.

Preferably the sensor is configured for mounting on the mortar barrel adjacent the open end of the barrel. Alternatively or in addition, the sensor can also be configured for mounting at the breech end of the mortar barrel or at a point between the breech end and the open end of the barrel.

The preferred embodiments of the invention incorporate various types of sensors, and their associated electronic circuits, for sensing the cartridge or jacket of the projectile. In one preferred embodiment the sensor includes a metal detector, such as a magnetic induction coil, and the electronic circuit is operative to detect changes in an electric current in the coil caused by a movement of the projectile past the coil. The magnetic coil can be arranged on one side of the barrel but it preferably forms a toroid surrounding the barrel.

In another preferred embodiment the sensor includes a primary coil and a secondary coil, and the electronic circuit is operative (1) to pass an electric current through the primary coil, and (2) to detect changes in an electric current induced in the secondary coil caused by a movement of the projectile past the secondary coil.

In another preferred embodiment the sensor includes a permanent magnet and an adjacent coil of wire windings surrounding the barrel. The electronic circuit is operative to detect when a metal projectile passes through the barrel at the location of the wire windings, the resulting fluctuations in the magnetic flux and the associated current indicating that a metal projectile has transited the barrel.

In still another embodiment the sensor includes a thermal sensor and the electronic circuit is operative to detect changes in temperature or the thermal radiation produced by hot propulsive gases emitted by the projectile as it is launched from the barrel. In this case the thermal sensor is preferably configured for mounting on the mortar barrel adjacent to its open upper end.

In yet another embodiment the sensor includes a visible or ultraviolet light sensor and the electronic circuit is operative to detect the light of the pyrotechnic propulsive emissions from the tail of the projectile as it is launched from the barrel. In this case also, the light sensor is preferably configured for mounting on the mortar barrel adjacent its open upper end.

In another embodiment the sensor includes a radiation emitter and a radiation sensor disposed on opposite sides of the barrel and the electronic circuit is operative to detect changes in radiation received by the radiation sensor caused by the passage of the projectile between the emitter and the sensor. In this case too, the emitter and the sensor are configured for mounting on the mortar barrel adjacent the open end of the barrel.

The radiation employed with this system is preferably either visible light or ultraviolet light and the emitter is preferably a laser.

Finally, the safety device according to the invention advantageously comprises also a lineal accelerometer configured for mounting on the mortar barrel, and a second electronic circuit, coupled to the accelerometer, for detecting the launch of the projectile from the barrel, thereby to determine the instant of launch. Coupled with the projectile sensor at the open end of the barrel, this enables the system to determine the exit velocity of the projectile from the barrel.

In summary, the mortar safety device according to the invention first detects a projectile entering the barrel of a mortar and thereafter the same projectile exiting the barrel, provides an audible and/or visual warning when the projectile has not timely exited the barrel. The safety device preferably provides (1) a mid-barrel sensing of the change in magnetic flux (field) when a projectile passes within a barrel using an outer coil or magnetometer, and/or (2) sensing of the projectile (either visually or by the light or temperature of the propulsive gases) at the open end of the barrel when projectile is loaded and when it exits the barrel. By using one of these forms of sensing and with the option to couple a shock detector to determine the instant that each projectile fires, the device can identify a dangerous condition (that a projectile has entered the barrel but has not yet fired and exited the barrel) and thus warn the operator not to load a new round.

The various forms of projectile sensing according to the invention are summarized in the following table. The table indicates those sensors that are preferably mounted adjacent the open muzzle end of the mortar barrel. The magnetic sensors can be mounted at any point along the barrel.

Methods for Sensing Projectile entering and departing barrel.

| Approach | | Concept | Ease of Retrofit to USMC Mortars |
|---|---|---|---|
| Muzzle Sensor | Magnetic Induction | Variation (flux) of the magnetic field due to change in the metallic mass of the mortar-round system | Ease to retrofit in USMC mortar External coils and power supply Electronic controller |
| | Magnetic | Magnetometers located outside the barrel detect the flux as a mortar projectile passes thru the mortar. | Possible limitation due to external metallic sources no related to the mortar-round system |
| | Thermal | Thermal (IR) sensor located at the muzzle | This system will detect the flash and hot gases from the muzzle blast. Not easy to retrofit |
| | Laser/ Light | Laser/light emitters in the muzzle with sensors to detect the loading and firing of the round | Possible to combine with velocity measurement. Not easy to retrofit, the detection system shall be installed in the muzzle. Possible improvement for a complete redesign of the mortar system |
| Shock | Acceler-ometers | Lineal accelerometers sensors located outside the barrel | This possible system only will sense if the round has been fired. Easy to retrofit |

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
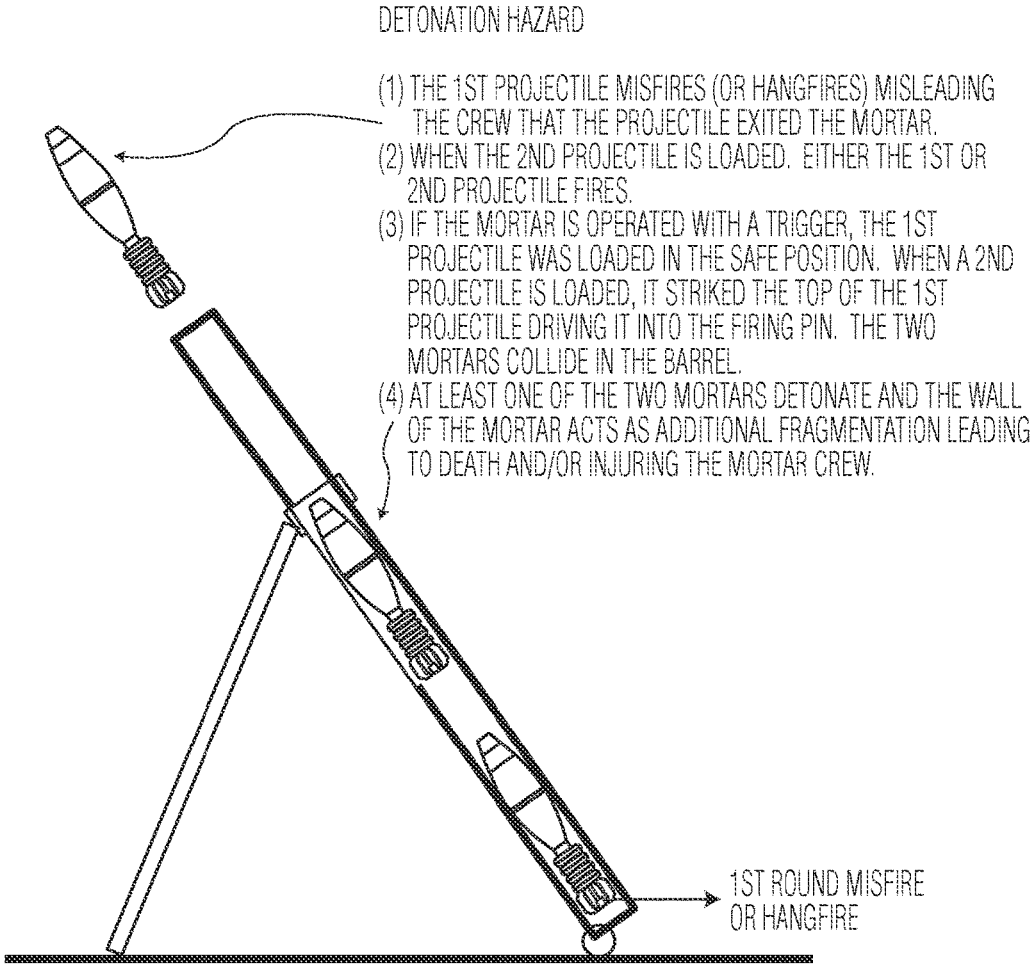
FIG. 1 is a representational diagram of a mortar illustrating the double-loading hazard addressed by the present invention.
Figure 2A:
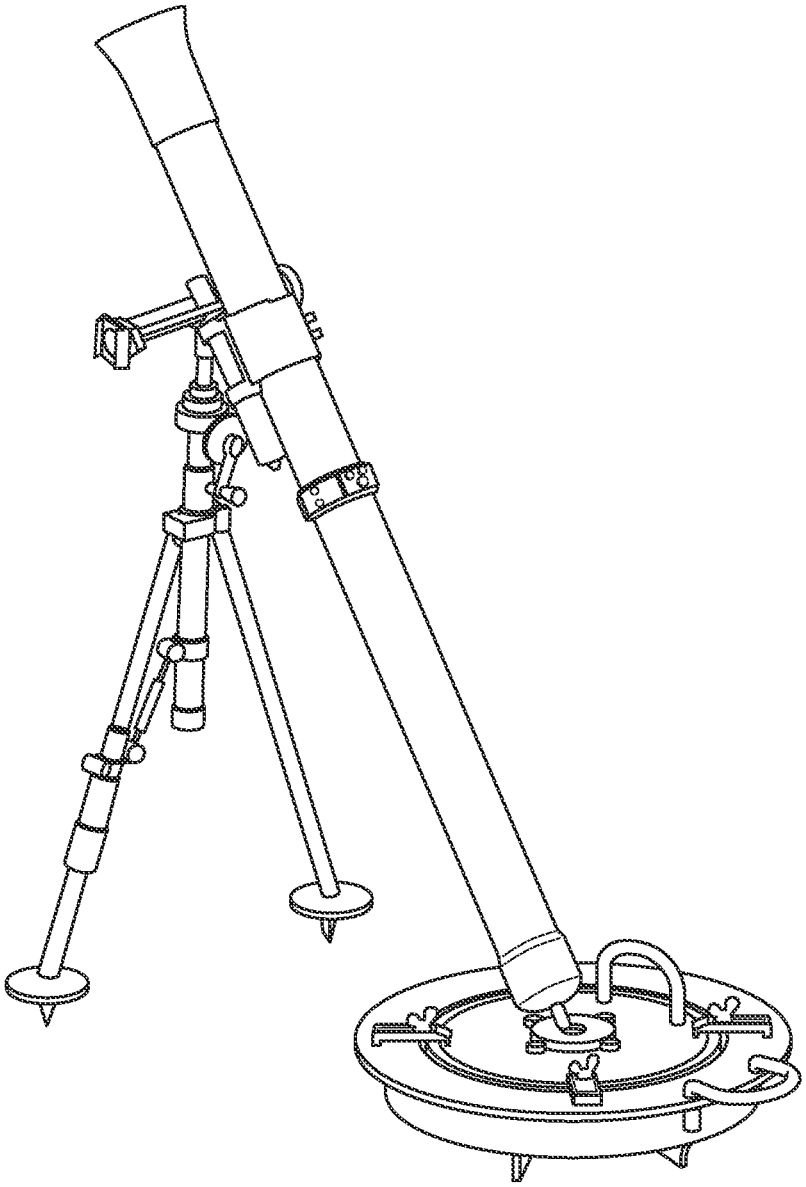
FIGS. 2A and 2B are perspective views of a mortar showing an externally mounted/retrofitted metal detector type device at two different locations on the mortar barrel.
Figure 2B:
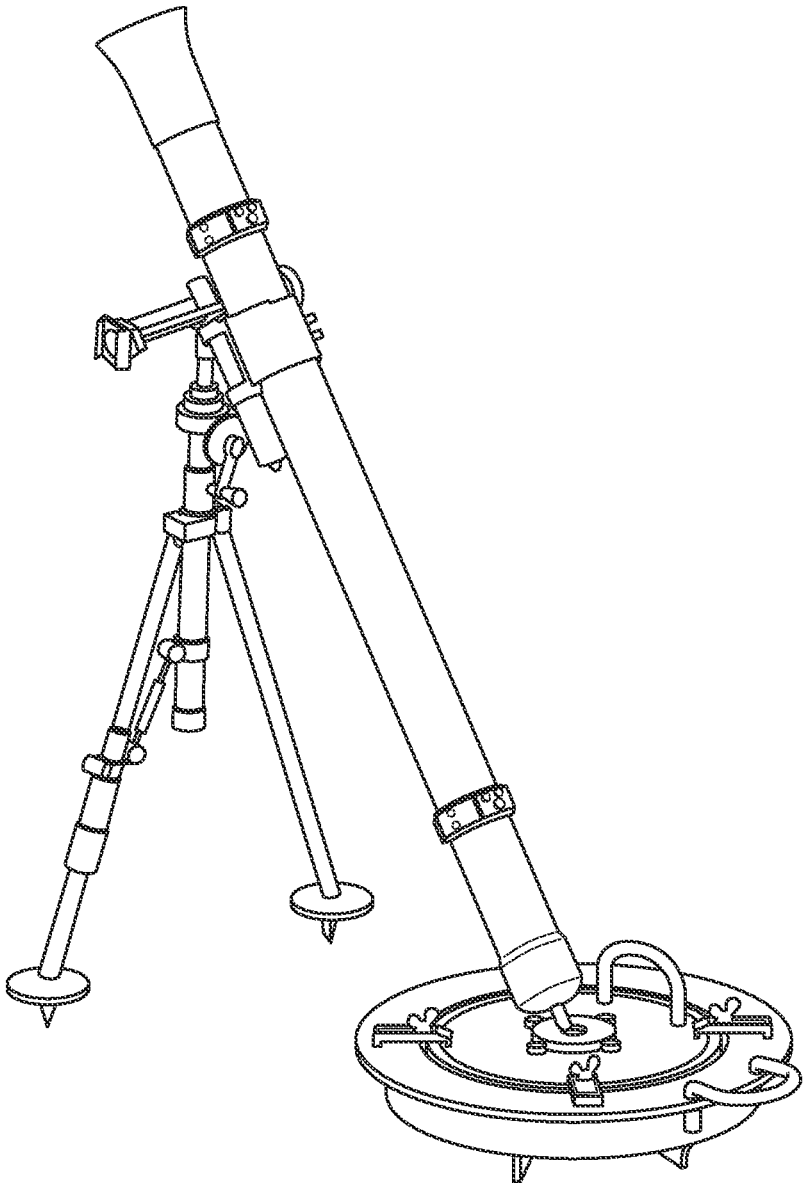
Figure 3A:
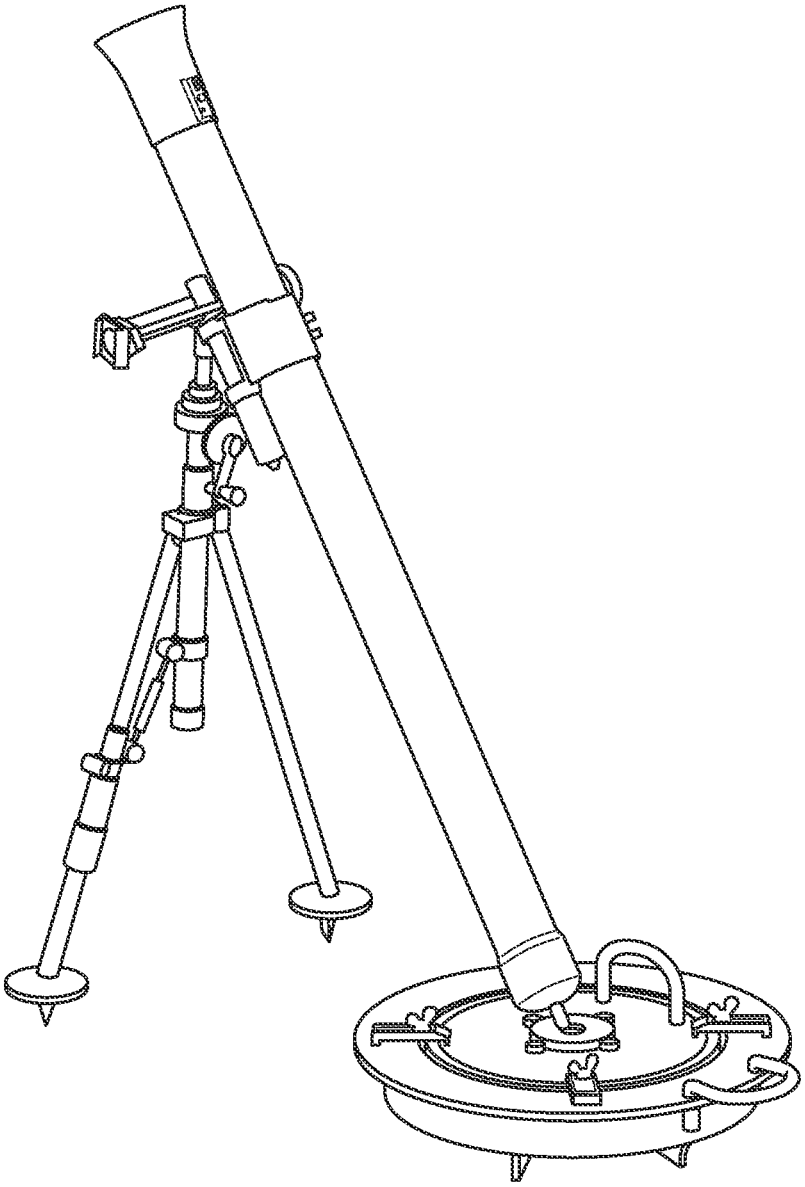
FIGS. 3A and 3B are perspective views of a mortar showing a radiation sensor type device (FIG. 3*b*) located at an upper, open end of the barrel.
Figure 3B:
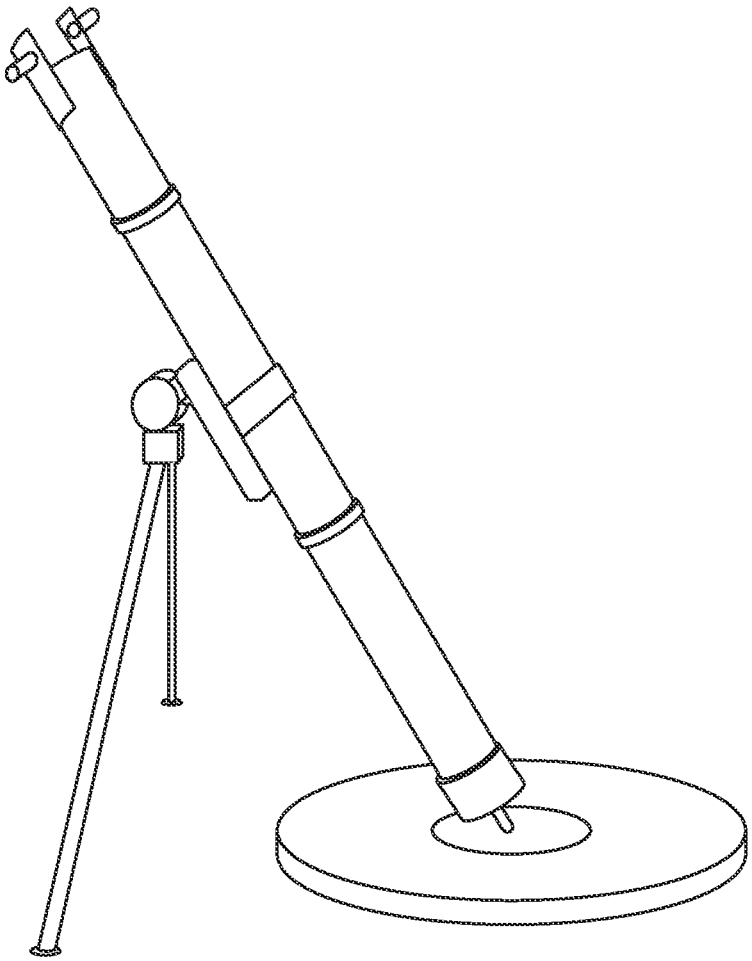

The preferred embodiments of the present invention will now be described with reference to FIGS. 1-21 of the drawings. Identical elements in the various figures are designated with the same reference numerals.

FIG. 1 illustrates the problem to which the present invention is addressed. This diagram shows how a mortar is subject to a "double projectile feed" creating a detonation hazard. When a projectile is inserted in a mortar at the upper, open end of the barrel, drops down to the lower, breech end where it is ignited, either right away by its contact with a firing pin at the breech end or on demand in response to a trigger pull. If, due to a hang-fire or due to confusion during firing, a second projectile is inserted before the first projectile is launched, the first projectile will collide with the second, causing an explosive hazard that can result in injury or death of the attendant mortar men.

Figure 5:
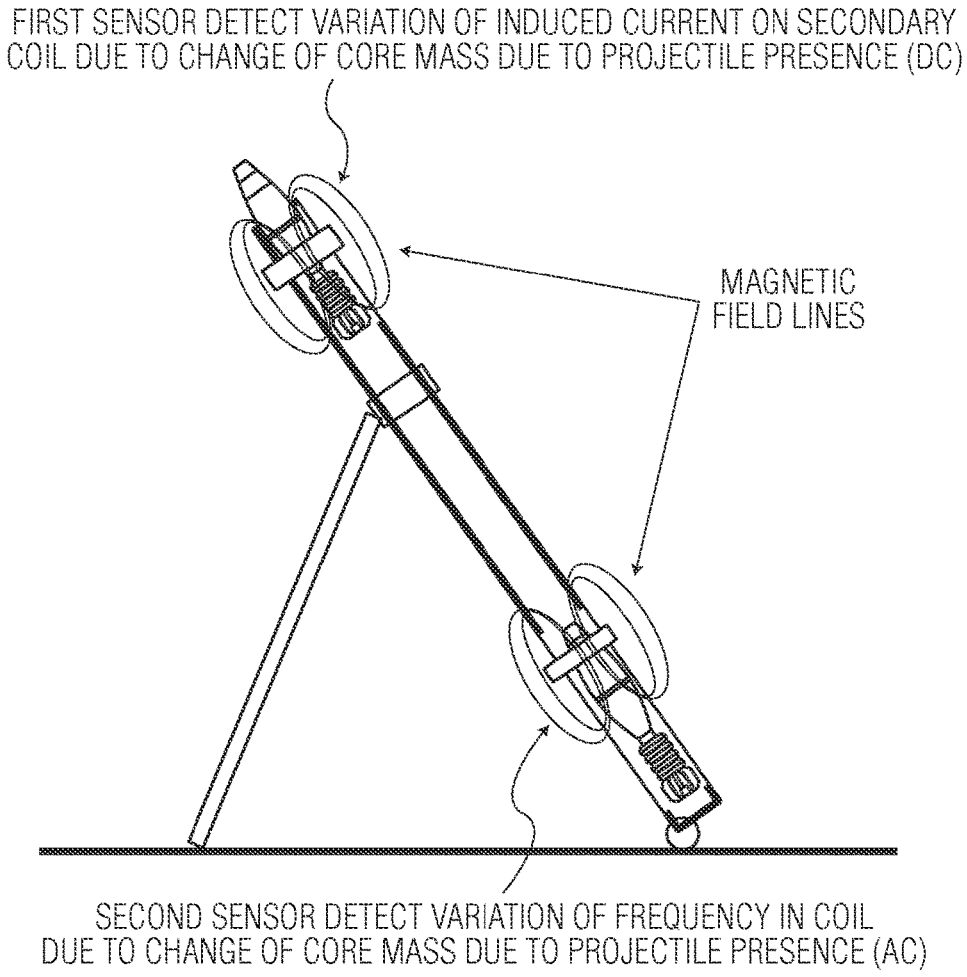
FIG. 5 is a representational diagram showing the magnetic field lines associated with metal body mortars with a dual-array magnetic detector device.
Figure 8:
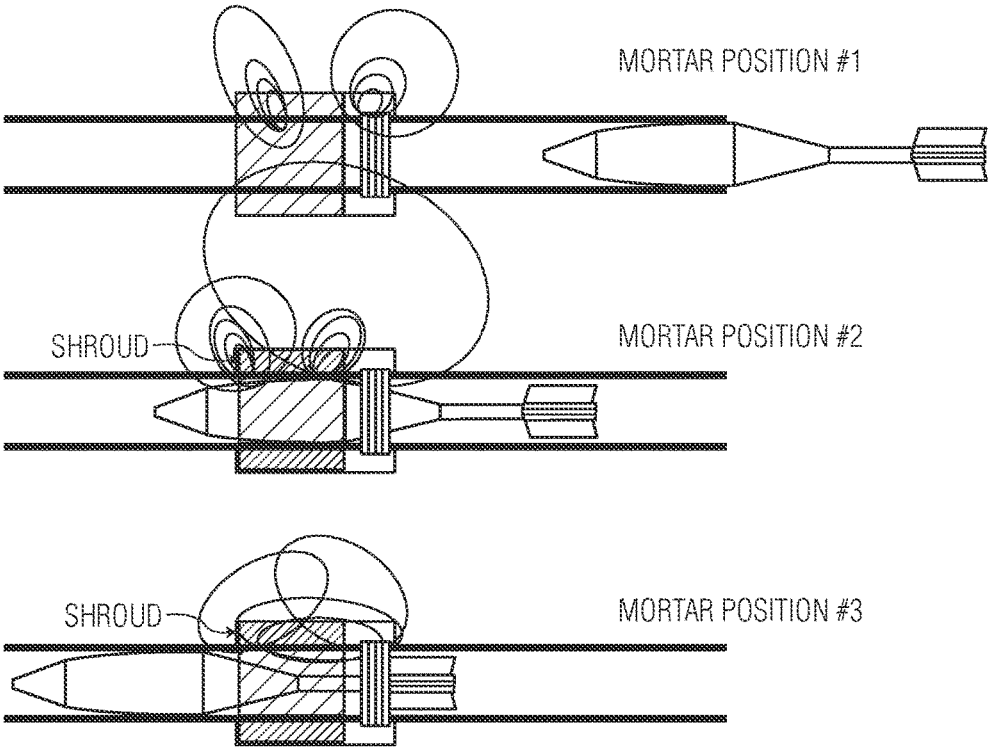
FIG. 8 is a cut-away view of a mortar barrel and a projectile, illustrating how magnetic fields fluctuate when the projectile moves from one to the next of three successive positions.

FIG. 8 illustrates an externally mounted/retrofitted metal detector mounted on a mortar barrel approximately midway between the open, upper end and the lower, breech end mounted on the breech block. FIG. 5 shows two metal detector devices mounted on the mortar barrel near each end. The metal detectors include a sensor for sensing the metal jacket of a mortar projectile upon its insertion in the barrel and an electronic circuit, coupled to the sensor, for detecting movement of the mortar projectile past the sensor, thereby to detect the presence of the projectile in the barrel.

Figure 21:
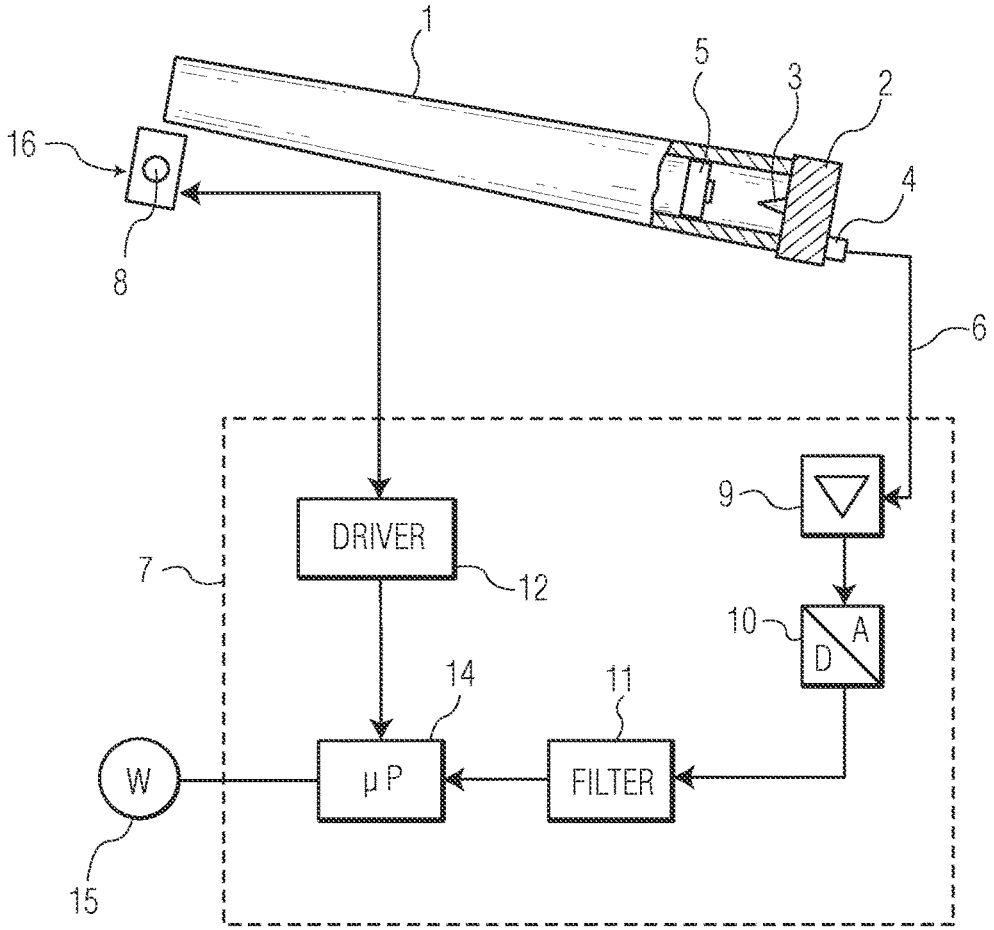
FIG. 21 shows the mortar safety device according to the present invention comprising a metal sensor, an associated electronic circuit and an audible and/or visual warning device.

FIG. 21 depicts a radiation sensor-type device on the muzzle of a mortar barrel (with a sensor not shown inside the muzzle break). The radiation sensor detects radiation (visible light, heat or ultraviolet) emanating from the base of the projectile as it is launched by the pyrotechnic propellant. FIG. 5 shows a radiation emitter and sensor located at the upper end of the barrel with a second metal detector positioned lower down on the barrel. Radiation produced by the emitter, which is preferably a laser, is continuously sensed by the radiation sensor unless and until it is interrupted or blocked by the passage of a projectile between the emitter and sensor.

Figure 4A:
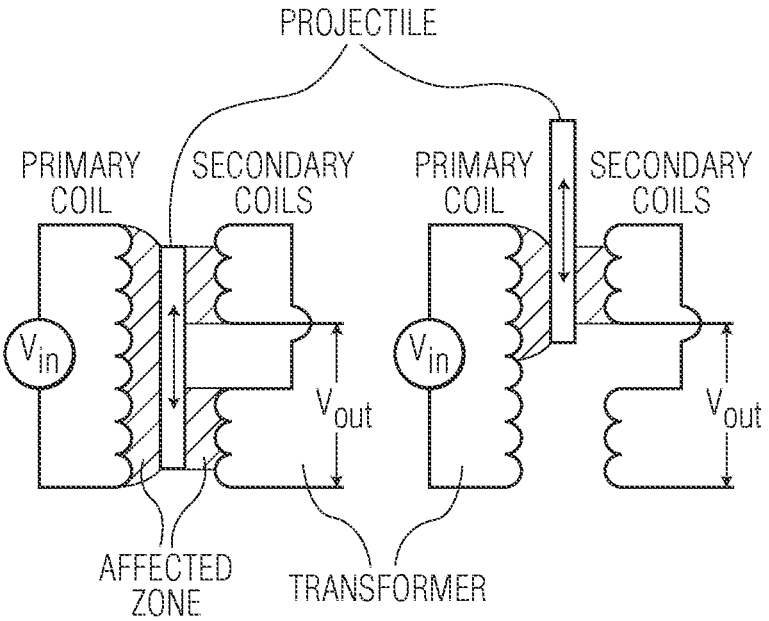
FIG. 4A shows two schematic diagrams of a dual-coil magnetic detector type device with an adjacent projectile in different positions.
Figure 4B:
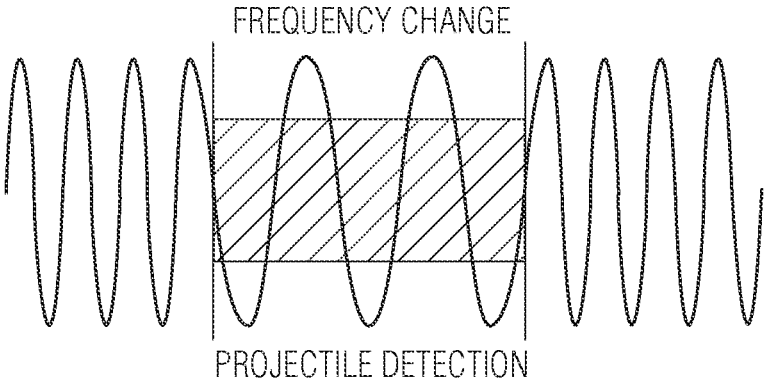
FIG. 4B illustrates a frequency change due to passage of the projectile.

FIG. 5 illustrates a projectile passing through two wiring coils resulting in both a voltage and a frequency change that is sensed by an electronic circuit (not shown). One wiring coil has a voltage applied, creating a magnetic field, and the second coil encounters a fluctuation in frequency when the projectile passes between the coils, as is illustrated in FIG. 4B.

FIG. 5 shows a dual-sensor design with the sensors located near the upper and lower ends of a mortar barrel. The diagram illustrates magnetic field lines associated with a metal jacket mortar projectile.

Figure 6:
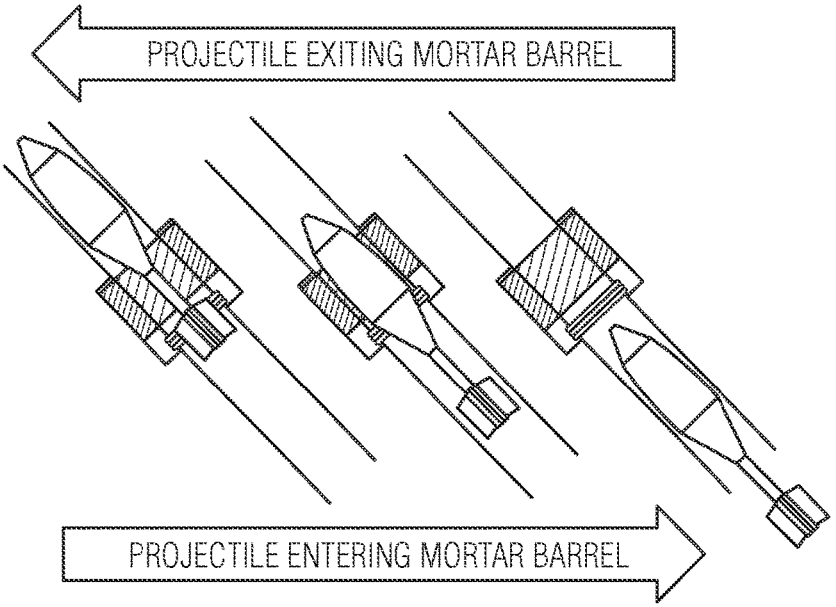
FIG. 6 is a representational diagram showing a mortar projectile passing through a mortar barrel with a magnet and coil winding configuration.

FIG. 6 depicts a projectile entering and exiting a mortar barrel with a toroidal permanent magnet and a coil wiring.

Figure 7:
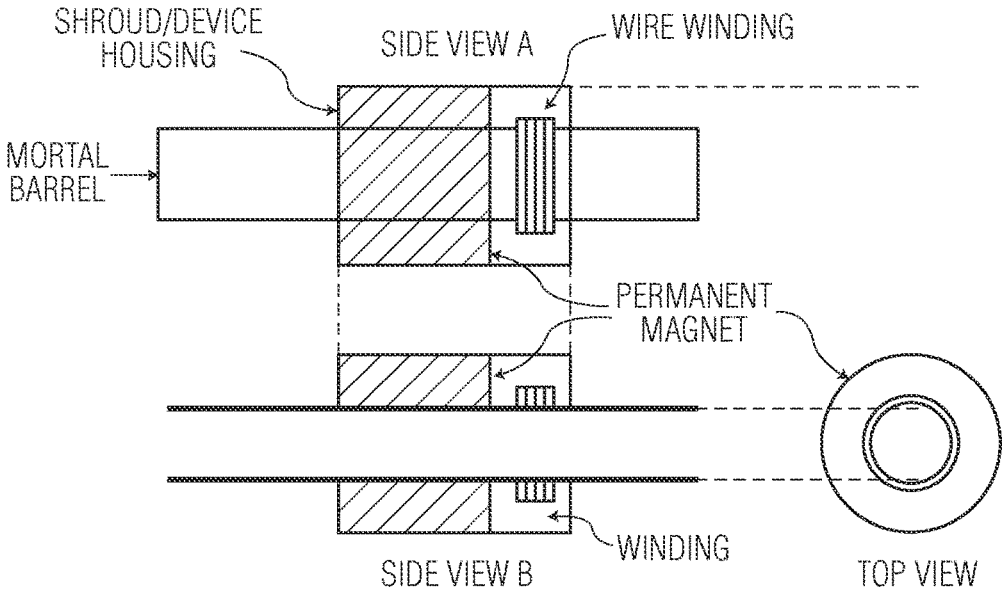
FIG. 7 is a detailed representational diagram of a metal detector type device with a permanent magnet and a coil winding.

FIG. 7 is a representational diagram of a sensor device with a permanent magnet and coil winding surrounding a mortar barrel.

FIG. 8 shows the sensor device of FIG. 7, illustrating how the magnetic field fluctuates when a projectile moves past the sensor inside the mortar barrel.

Figure 9:
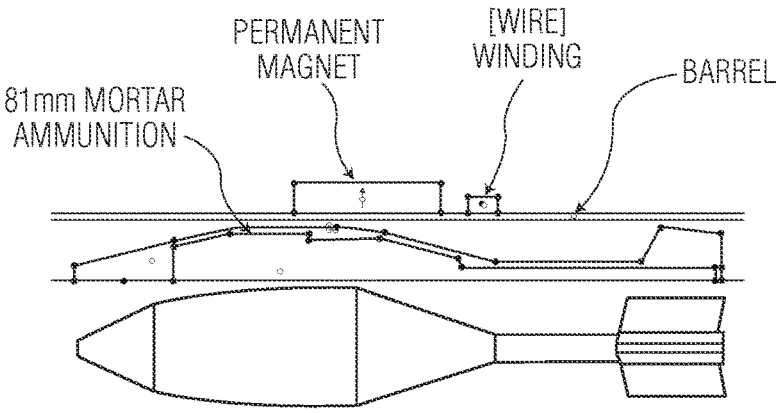
FIG. 9 is a representational diagram showing a projectile in a mortar barrel with an adjacent permanent magnet and a coil winding configuration of the type shown in FIG. 7.

FIG. 9 shows a mortar projectile, a permanent magnet and a coil winding surrounding a mortar barrel, forming the sensing device of FIG. 7. This configuration is used in the FEM Mesh illustration of FIG. 10 and the illustrations of field strength (field fluctuations) depicted in FIGS. 11-15.

Figure 10:
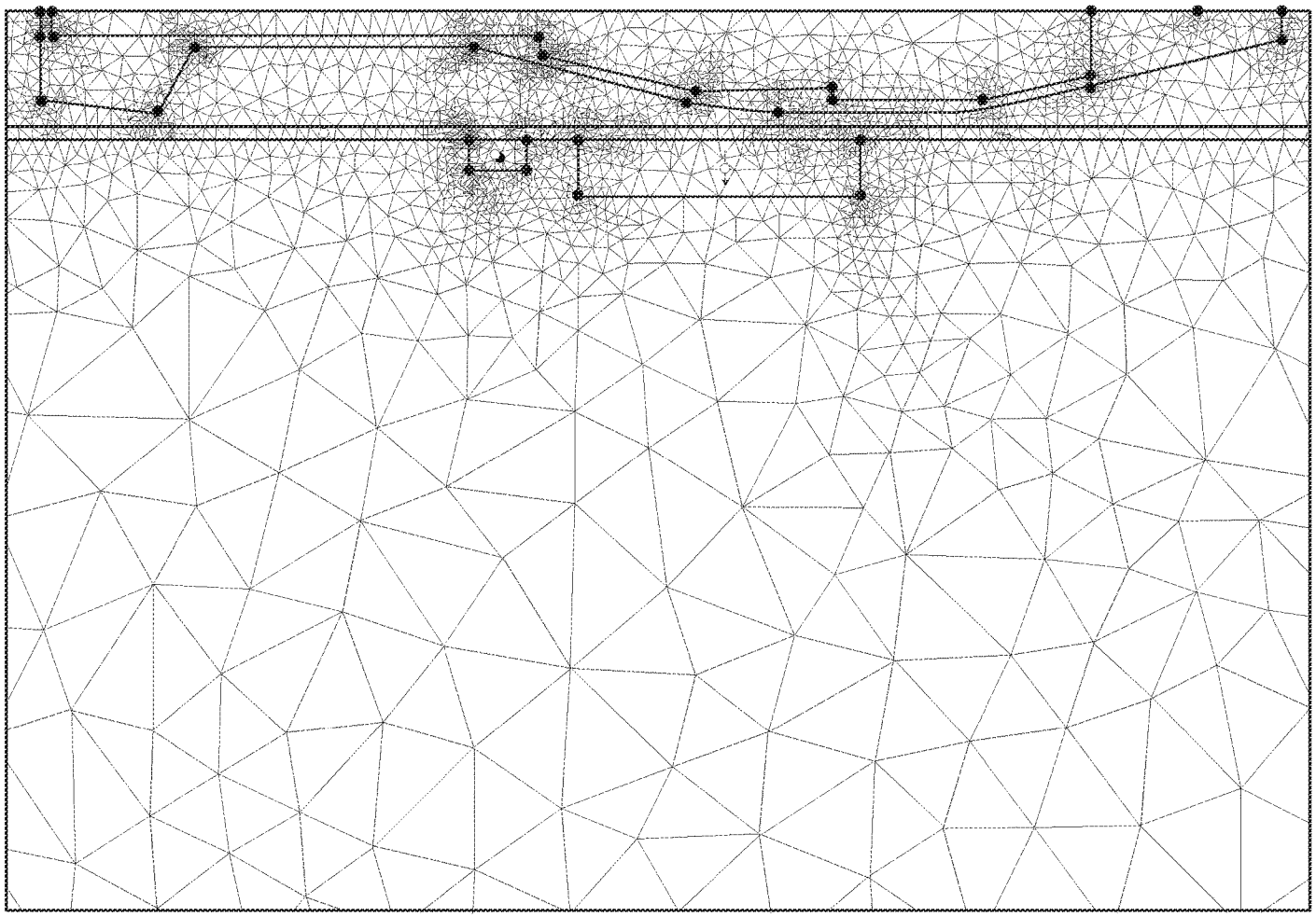
FIG. 10 is an FEM Mesh diagram of a mortar barrel with the magnet and coil configuration shown in FIGS. 7 and 9, illustrating the magnetic flux/field strength surrounding the projectile as it passes the magnet and coil.
Figure 11A:
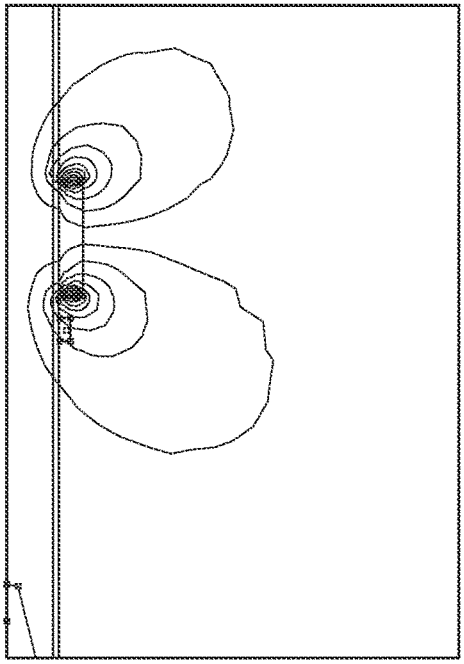
FIGS. 11A, 11B, 12A, 12B, 13A, 13B, 14A, 14B and 15 are representational diagrams illustrating the magnetic flux/field strength surrounding the projectile in a mortar barrel as it passes the magnet and coil configuration of FIG. 9 at successive points in time.
Figure 11B:
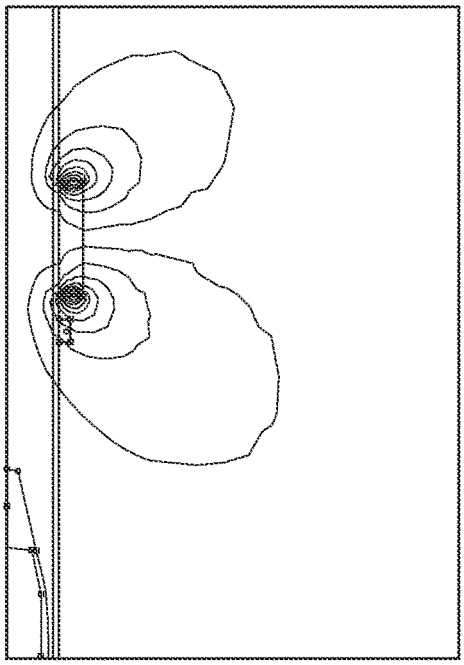
Figure 12A:
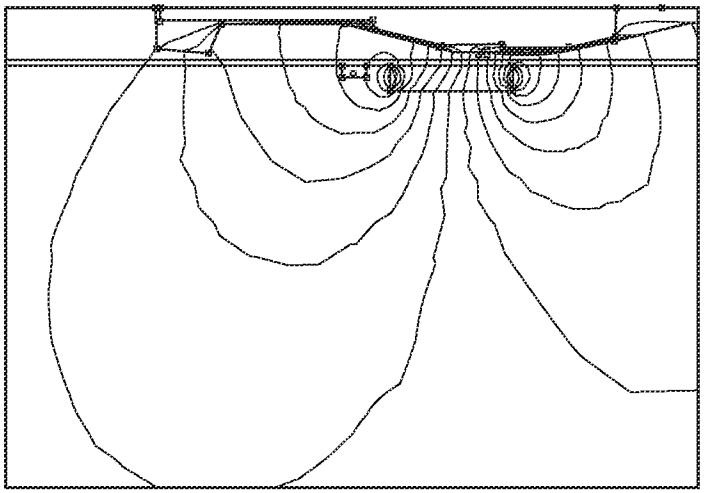
Figure 12B:
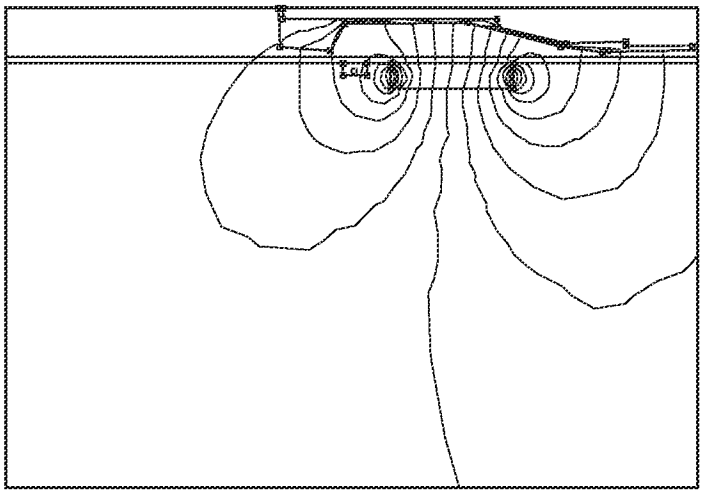
Figure 13A:
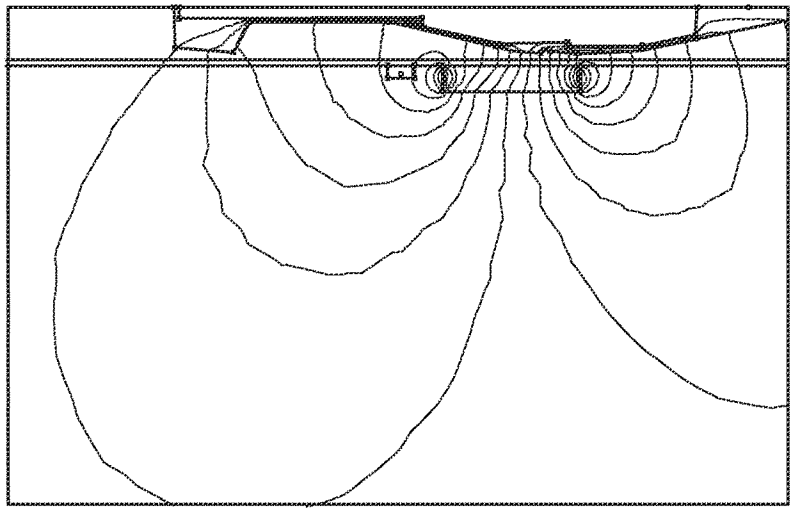
Figure 13B:
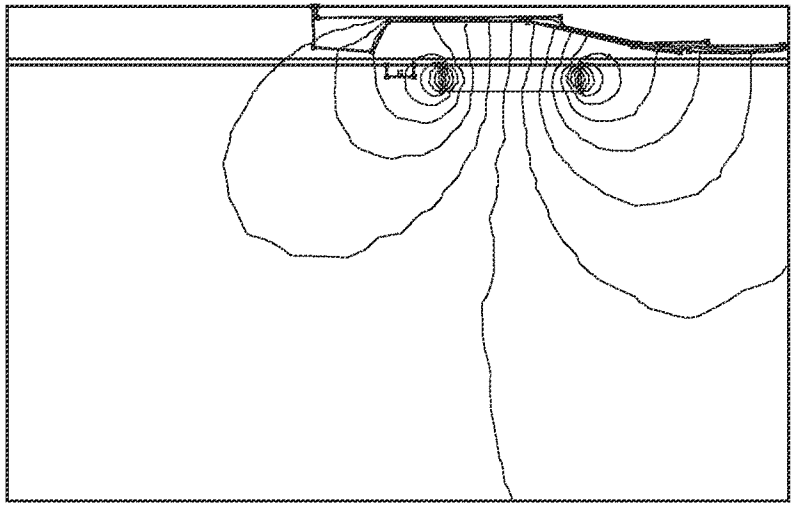
Figure 14A:
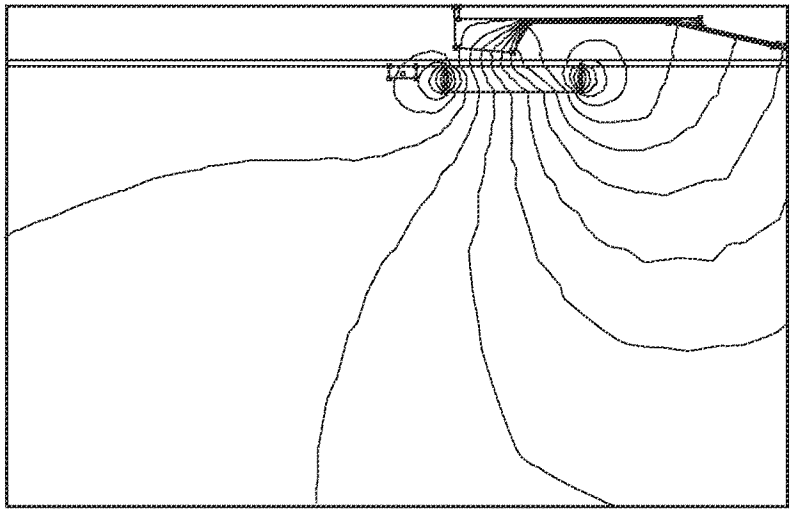
Figure 14B:
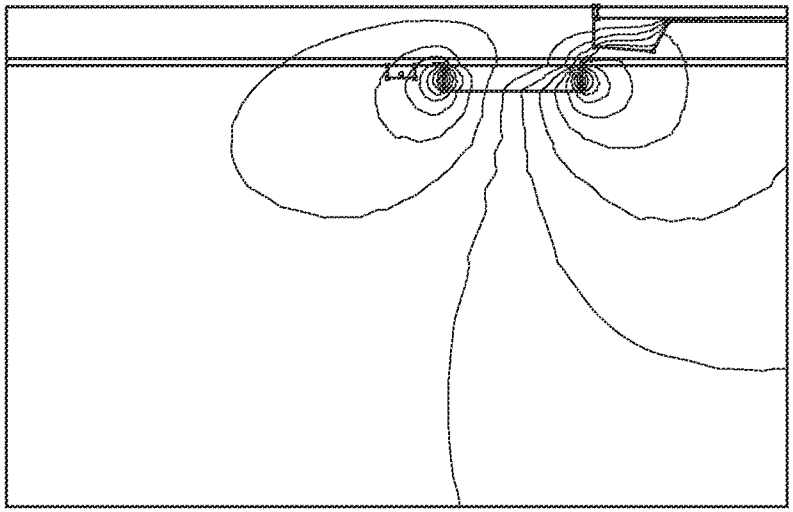
Figure 15:
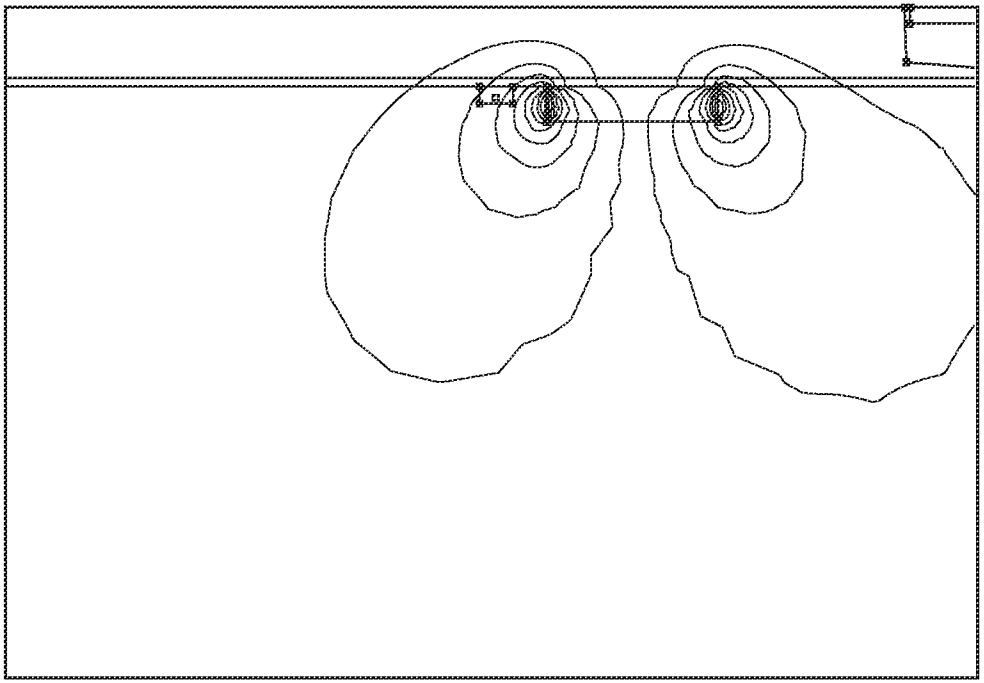

FIG. 10 shows an electromagnetic analysis FEM Mesh with a projectile in a mortar barrel shown in cross section.

FIGS. 11-15 depict the magnetic flux adjacent one side of a mortar barrel produced by the sensor device of FIG. 7 having a permanent magnet and coil winding surrounding the barrel. These figures show the changes in magnetic flux at successive points in time as a projectile moves through the barrel past the magnet and coil.

Figure 16:
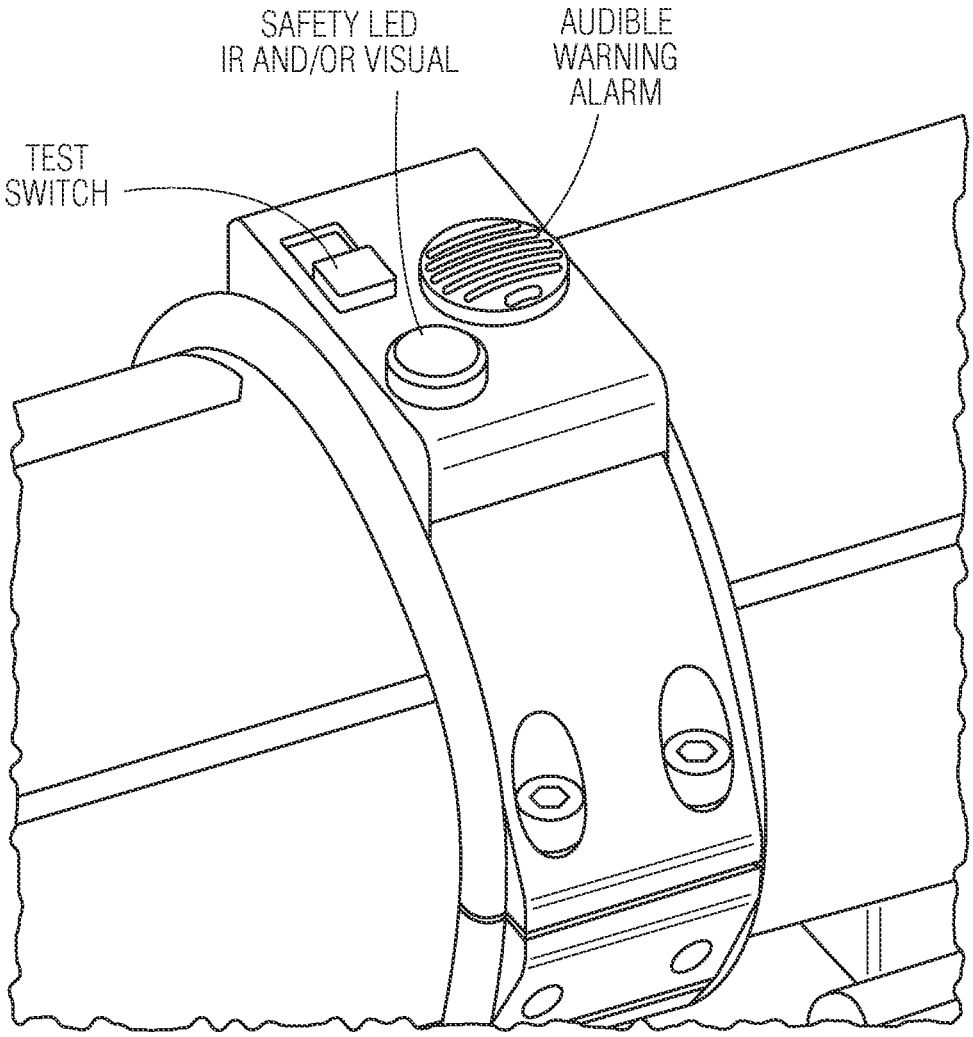
FIG. 16 is a perspective view of a projectile detector device according to the invention, mounted on the mortar with an audible and visual warning alarm.

FIG. 16 shows a mortar safety device with an audible and visual warning according to the present invention.

Figure 17A:
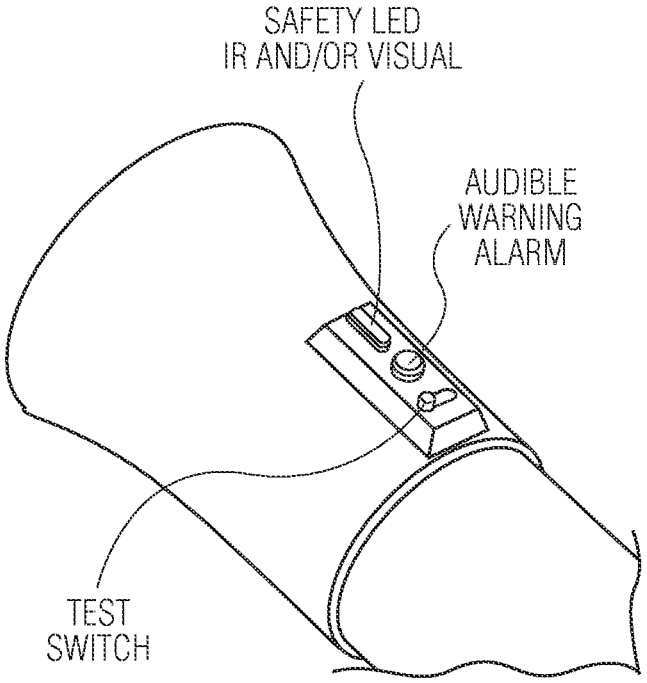
FIGS. 17A and 17B are close-up and distant perspective views, respectively, illustrating a projectile detector device according to the invention, mounted on the muzzle break with an audible and visual alarm.
Figure 17B:
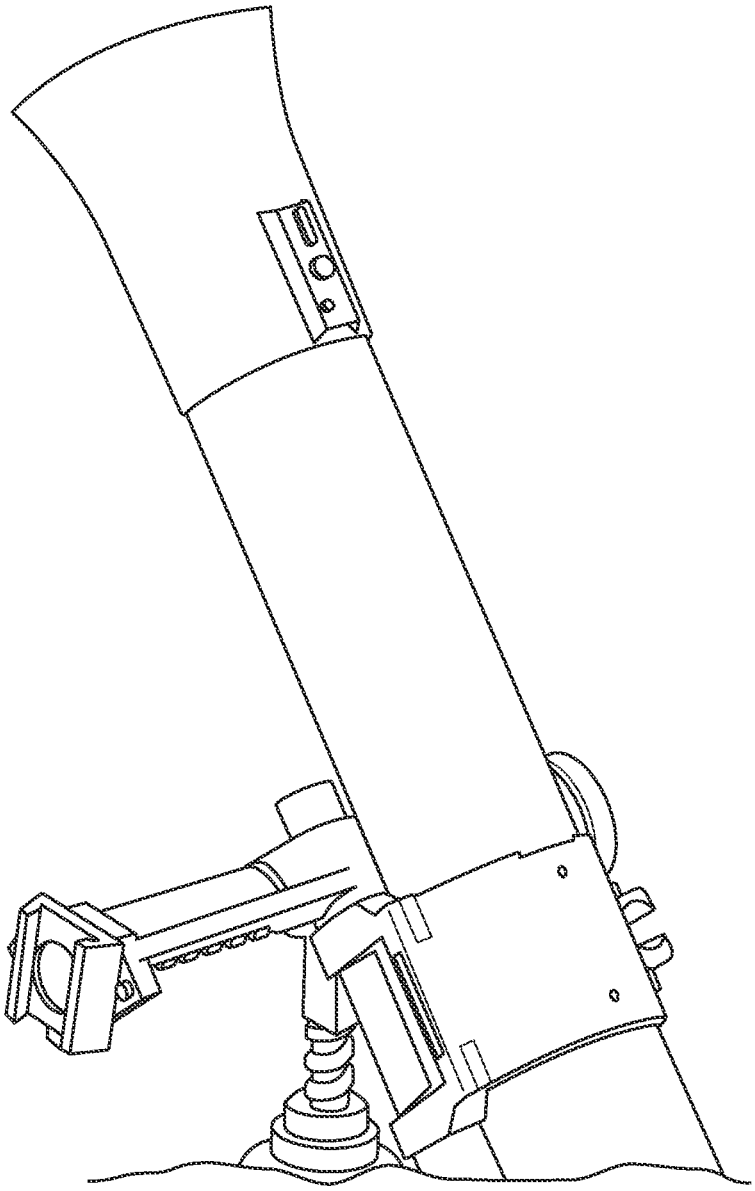

FIGS. 17A and 17B show a muzzle mounted safety device according to the present invention.

Figure 18:
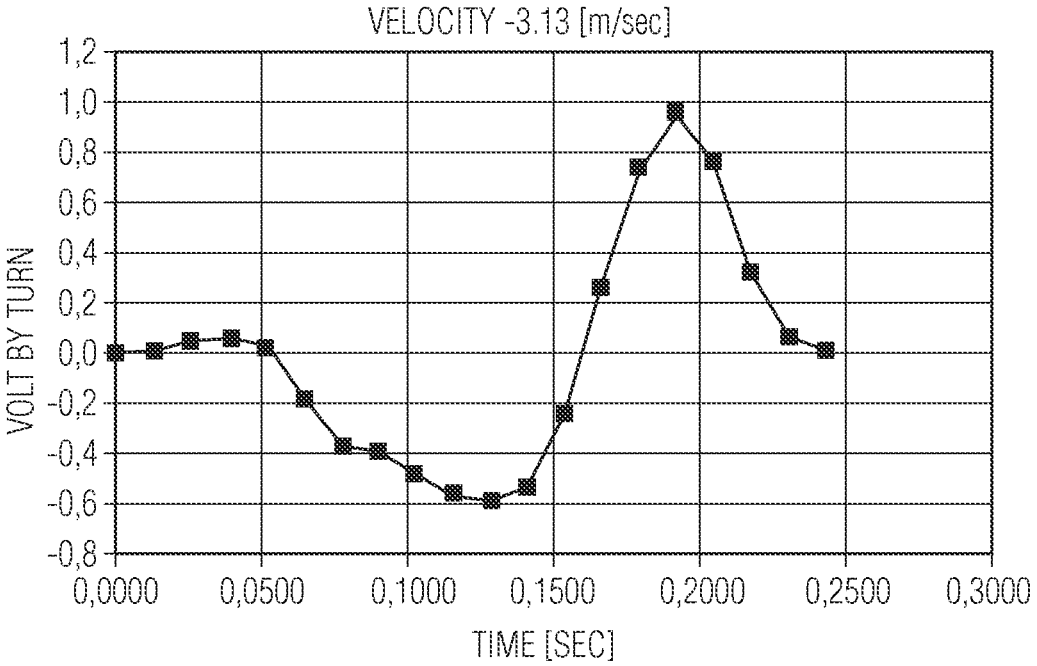
FIG. 18 is a voltage/time diagram illustrating the voltage induced in the winding coil of the magnet/coil configuration of FIG. 9, with a projectile falling in the mortar tube (pre-setback) with a velocity of 3.13 m/sec.
Figure 19:
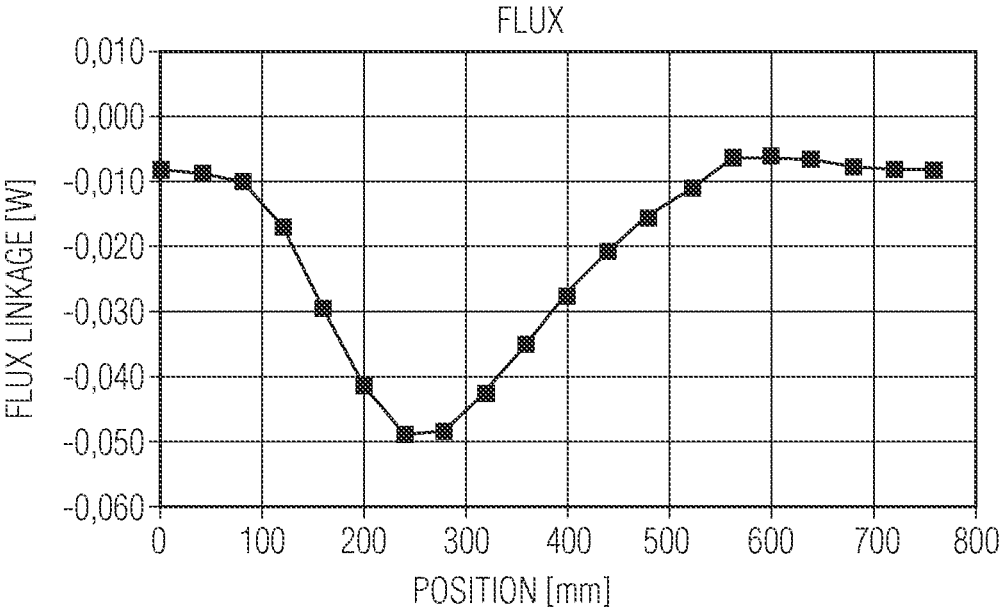
FIG. 19 is a magnetic flux/time diagram illustrating the flux induced in the winding coil of the magnet/coil configuration of FIG. 9 by traverse of a projectile in the mortar barrel.

FIG. 18 is a voltage/time diagram of the signal produced by the mortar safety device of FIG. 7 as a projectile is dropped down a mortar barrel (pre-setback) and passes the magnet and coil sensor with a velocity of 3.13 meters per second.

FIG. 9 shows the flux linkage (W) produced by the mortar safety device of FIG. 7 versus projectile position (mm) as a projectile traverses the mortar barrel.

Figure 20:
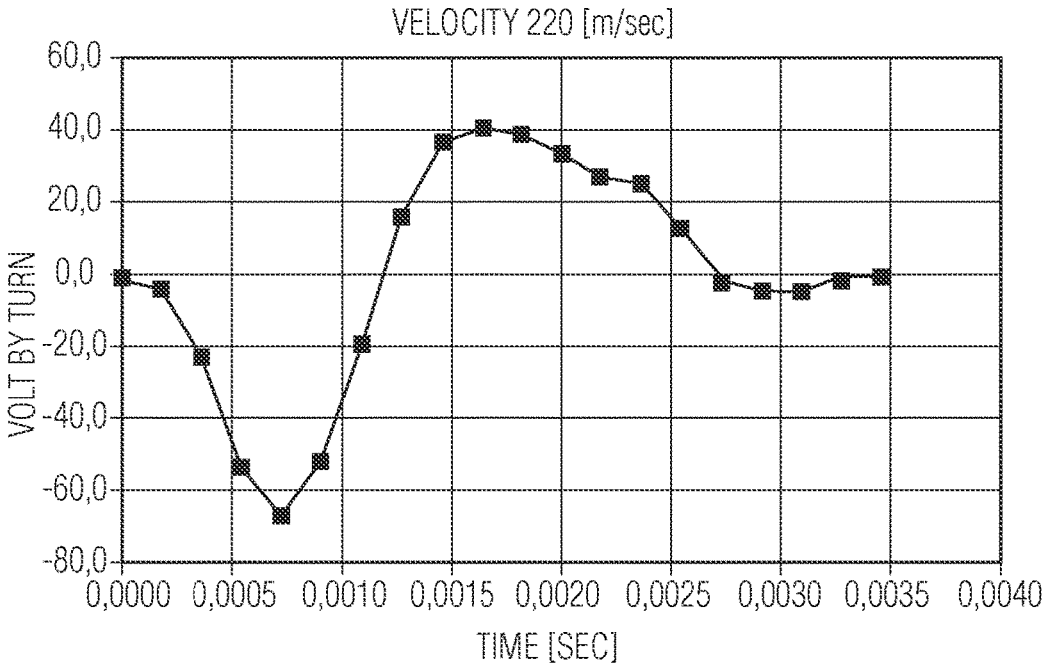
FIG. 20 is a voltage/time diagram illustrating the voltage induced in the winding coil of the magnet/coil configuration of FIG. 9, with a projectile under launch conditions traversing the mortar barrel at a velocity of 220 m/sec.

FIG. 20 is a voltage/time diagram of the signal produced by the mortar safety device of FIG. 7 as the projectile passes the magnet and coil surrounding the barrel at 220 meters per second prior to exiting the mortar barrel.

FIG. 21 shows the mortar safety device according to the invention comprising a metal sensor 16, an associated electronic circuit 7 and an audible and/or visual warning device 15. The metal sensor shown in this case comprises a single coil winding 8. Alternatively, the metal sensor may include both a primary coil and secondary coil as shown in FIG. 4*a*.

The mortar barrel 1 is provided with a breechblock 2 carrying a firing pin 3 to ignite the propellant in the projectile 5. When the projectile 5 is dropped into the open, upper end of the barrel 1 and its igniter contacts the firing pin 3 and, upon firing, ignites the propellant.

A driver 12 in the electronic circuit 7 passes current through the coil winding 8 and senses fluctuations in the signal caused by the passage of the projectile as it leaves the barrel. A microprocessor 14 keeps track of the entry and exit of projectiles to and from the mortar barrel and causes the warning device 15 to sound the alarm if a projectile remains in the barrel longer than expected.

An acceleration sensor 4 is provided to determine the moment of launch of each projectile. This sensor is also connected to the electronic circuit 7 through a conductor 6. The circuit 7 includes an input amplifier 9, an analog-to-digital converter 10 and a digital frequency filter 11, in turn connected to the microprocessor 14.

The frequency range of the digital filter 11 is selected such that only those frequency portions of the measuring signal are passed which are characteristic of the launch of a projectile. The digital signal values obtained at the output of the frequency filter 11 are thereafter passed to the microprocessor 14 which measures the time between the launch of the projectile and its exit from the mortar barrel (as sensed by the metal detector 15) and computes the exit velocity of the projectile.

There has thus been shown and described a novel mortar safety device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A safety device for a front-loading weapon comprising a mortar barrel having a closed breech end and an opposite open end for launching a mortar projectile, said safety device comprising, in combination:

(a) at least one sensor, mounted on the mortar barrel, for sensing a mortar projectile when the projectile moves past the sensor within the barrel;

(b) an electronic logic circuit, coupled to said sensor, for detecting the presence of the mortar projectile in the barrel as the projectile moves past said sensor, both when entering and exiting the barrel, and for determining when the mortar projectile remains inside the barrel longer than expected; and (c) a warning device, coupled to said electronic logic circuit, for providing at least one of a visual and audible warning when the mortar projectile remains in the barrel longer than expected and has thus failed to timely fire, whereby a weapon user is warned against inserting another mortar projectile into the barrel.

2. The safety device of claim 1, wherein said warning device produces at least one of an audible and a visual indication of the presence of the mortar projectile in said barrel.

3. The safety device of claim 1, wherein said sensor is mounted on the mortar barrel adjacent said open end of said barrel.

4. The safety device of claim 1, wherein said sensor is mounted on the mortar barrel substantially midway between said breech end and said open end of said barrel.

5. The safety device of claim 1, wherein said sensor is mounted on the mortar barrel adjacent said breech end of said barrel.

6. The safety device of claim 1, wherein said sensor includes a metal detector.

7. The safety device of claim 6, wherein said metal detector includes a coil of wire windings and said electronic circuit is operative to detect changes in an electric current in said coil caused by a movement of the projectile past said coil.

8. The safety device of claim 7, wherein said wire windings of said coil surround said barrel.

9. The safety device of claim 6, wherein said metal detector includes comprises a primary coil and a secondary coil, and wherein said electronic circuit is operative to pass an electric current through said primary coil and to detect changes in an electric current induced in a said secondary coil caused by a movement of the projectile past said secondary coil.

10. The safety device of claim 6, wherein said metal detector includes a permanent magnet and a coil of wire windings surrounding the barrel, and wherein said electronic circuit is operative to detect when a metal projectile passes through the barrel at the location of the wire windings, a resulting fluctuation in magnetic flux and current indicating that a metal projectile has transited through the barrel.

11. The safety device of claim 1, wherein said sensor includes a thermal sensor and said electronic circuit is operative to detect changes in temperature caused by hot propulsive gases produced by the projectile as it is launched from said barrel.

12. The safety device of claim 11, wherein said thermal sensor is configured for mounting on the mortar barrel adjacent said open end of said barrel.

13. The safety device of claim 1, wherein said sensor includes a radiation emitter and a radiation sensor disposed on opposite sides of said barrel and wherein said electronic circuit is operative to detect changes in radiation received by said radiation sensor caused by a movement of the projectile between said emitter and said sensor.

14. The safety device of claim 13, wherein said emitter and said sensor are configured for mounting on the mortar barrel adjacent said open end of said barrel.

15. The safety device of claim 13, wherein said radiation is visible light.

16. The safety device of claim 13, wherein said radiation is ultraviolet light.

17. The safety device of claim 13, wherein said emitter is a laser.

18. The safety device of claim 1, wherein said sensor includes a radiation detector and wherein said electronic circuit is operative to detect changes in radiation received by said radiation sensor from a pyrotechnic propellant of the projectile.

19. The safety device of claim 18, wherein said radiation detector is configured for mounting on the mortar barrel adjacent said open end of said barrel.

20. The safety device of claim 18, wherein said radiation is visible light.

21. The safety device of claim 18, wherein said radiation is ultraviolet light.

22. The safety device of claim 18, wherein said radiation is in the thermal radiation band.

23. The safety device of claim 1, further comprising a linear accelerometer configured for mounting on the mortar barrel, and a second electronic circuit, coupled to said accelerometer, for detecting changes in acceleration caused by the launch of the projectile from the barrel, thereby to determine the instant of launch.

* * * * *